United States Patent [19]

Sunshine

[11] 4,133,069

[45] Jan. 9, 1979

[54] REAMING TOOL

[76] Inventor: Nathan Sunshine, 308 Dunstable Ct., Raleigh, N.C. 27604

[21] Appl. No.: 826,398

[22] Filed: Aug. 22, 1977

[51] Int. Cl.[2] ..... B08B 9/02

[52] U.S. Cl. ..... 15/104.1 R; 15/104.01 R; 15/236 R

[58] Field of Search ..... 15/104.05, 104.09, 104.1 R, 15/104.01 R, 236 R; 29/81 F, 81 G

[56] References Cited

U.S. PATENT DOCUMENTS

| | | | |
|---|---|---|---|
| 1,443,860 | 1/1923 | Anderson | 15/104.01 R |
| 2,003,629 | 6/1935 | Coffey | 15/104.01 R |

*Primary Examiner*—Edward L. Roberts

*Attorney, Agent, or Firm*—Mills & Coats

[57] ABSTRACT

In abstract, a preferred embodiment of this invention is a self-adjusting pipe and coupling reamer which fits a multiplicity of different size pipes. The reamer includes generally flat, T-shaped scrappers whose corners act as cutting edges and the space therebetween prevents debris build-up.

3 Claims, 4 Drawing Figures

REAMING TOOL

This invention relates to hand tools and more particularly to plumbing type pipe and coupling reamers.

For many years after the advent of central water supply systems iron pipes were used which were of adequate thickness to allow male and female threads to be used between the pipes and their associated couplings and joints.

With the advent of copper and similar types of metals for water and similar conduits, the making of the walls thick enough to hold threads was not practical because of the much greater cost over the old iron pipes. The practical solution to effectuate the seal between the pipes and couplings was to solder the same. This is done by heating the male and female portions of the pipe and coupling to the point where solder will liquify and run between the two thus sealing the same.

The problem encountered with this procedure is that the pipes and couplings are coated during manufacture for protection against corrosion caused by substances in the ambient air prior to installation. This coating must be removed for an adequate solder joint to be effectuated.

To remove the coatings in question, sandpaper has been used on the exterior pipe which generally forms the male portion to be inserted into the female coupling. To remove the coating from the inside of the coupling (whether a coupling sleeve, an elbow, a valve or a fixture) either sandpaper, steel wool, wire brushes, or other abrasives have been used. These abrasive cleaning or reaming means have been inadequate at best, particularly with the smaller diameters wherein the plumber cannot put his finger inside the female portion.

A knife or other blade for scrapping the same is inadequate since it is practically impossible to maintain the same with any substantial surface contact thus giving spotty or unacceptable soldering characteristics.

Stiff wire brushes have been widely used for cleaning of the female portions of the smaller diameter joints but these are extremely unhandy and inadequate for two reasons; first, each size pipe requires a different size brush and secondly, the bristles of the brush very quickly become bent and tangled to the point of being unusable. Because of this, a relatively large number of brushes that are necessary for professionals in the plumbing business and the cost for any given job is proportionally increased.

After much research and study into the above-mentioned problems, the present invention has been developed to provide a hand tool like device which will fit a large variety of different sized couplings and pipes. This device is self-adjusting, gives superior results of surface coating and burr removal while having an almost infinite useful life.

In view of the above, it is an object of the present invention to provide a pipe and coupling reamer which is self-adjusting to fit a plurality of different interior dimensions.

Another object of the present invention is to provide a pipe and coupling reamer which is self-adjusting to give parallel surface contact to the cutting or scrapping edges.

Another object of the present invention is to provide, in a single hand tool, a pipe and coupling reamer which is self-adjusting to fit a plurality of different size pipes and couplings.

Another object of the present invention is to provide a pipe and coupling reamer with a plurality of parallely disposed cutter blades.

Another object of the present invention is to provide a pipe and coupling reamer having four scrapping surfaces all in longitudinal juxtaposed contact with the interior walls of the pipe or coupling means being reamed.

Another object of the present invention is to provide a pipe and coupling reamer which is inexpensive to manufacture and yet has an extremely long wear life.

Another object of the present invention is to provide a pipe and coupling reamer wherein the reaming blades can be quickly changed when replacement of the same becomes necessary.

Other objects and advantages of the present invention will become apparent and obvious from a study of the following description of the accompanying drawings which are merely illustrative of such invention.

Figure 1:
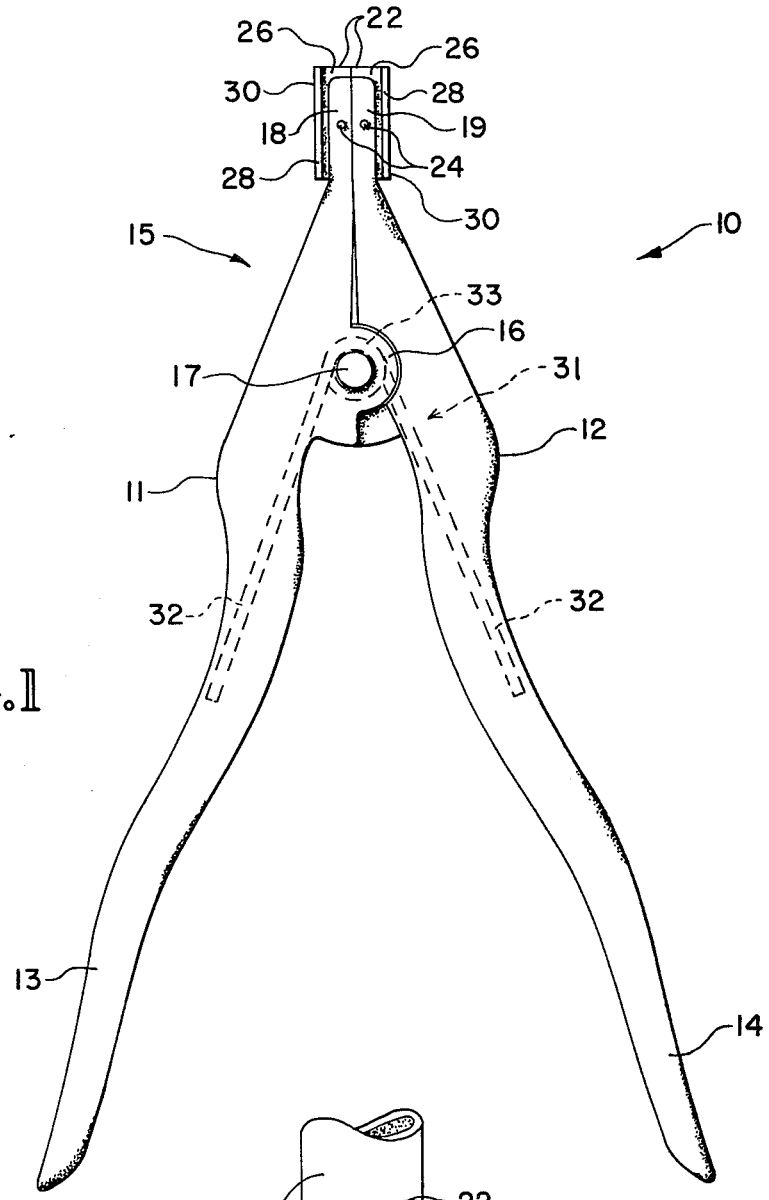
FIG. 1 is a side elevational view of the pipe and coupling reamer of the present invention.

With further reference to the drawings, the pipe and coupling reamer of the present invention, indicated generally at 10, is composed of a pair of stamped or otherwise formed elongated members 11 and 12. Each of the members 11 and 12 includes a handle portion indicated at 13 and 14, respectively. The end of each of the members 11 and 12 opposite handles 13 and 14 forms a head portion indicated generally at 15.

A tab or shoulder 16 is formed on each side of each of the members of 11 and 12 in the area of the head portion 15. The spacing between the tabs or shoulders 16 is such that they cooperatively fit with the tabs of the other member.

A pivot pin 17 is provided which passes through the tabs 16 of each of the members 11 and 12 thus forming a pivotable joint therebetween.

A piece of spring steel such as that indicated at 31 is provided. This spring includes end portions 32 which are preferably coiled at 33 around pivot pin 24 thus biasing handles 13 and 14 outwardly away from each other and blade support portions 18 and 19 together.

Figure 3:
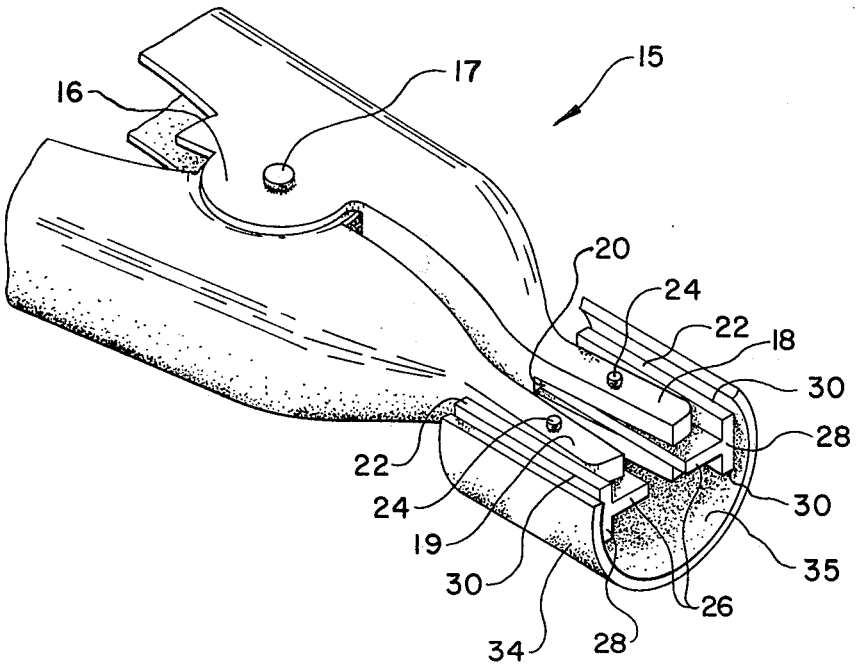
FIG. 3 is an enlarged fragmentary view of the portion of the reamer shown in FIG. 2.

The ends of each of the members 11 and 12 opposite handles 13 and 14 terminate in blade support portions 18 and 19, respectively. Each of the support portions has provided therein a slot 20. A pair of elongated, T-shaped blade means 22 are adapted to be pivotably received within slots 20. Blade pivot pins 24 are provided as seen clearly in the Figs., particularly in FIG. 3.

Each of the elongated, T-shaped blades 22 includes a central portion 26 which is adapted to be disposed within slot 20. Each of the blade means also includes a flat portion 28 fixedly secured to the respective central portion 26. The outermost corners of each of the flat portions 28 of each of the blades 22 form a sharp corner which is in effect a cutting edge and are indicated at 30.

Blades 22 as hereinabove described can be formed from stock extrusions and are preferably case hardened for long wear.

Figure 2:
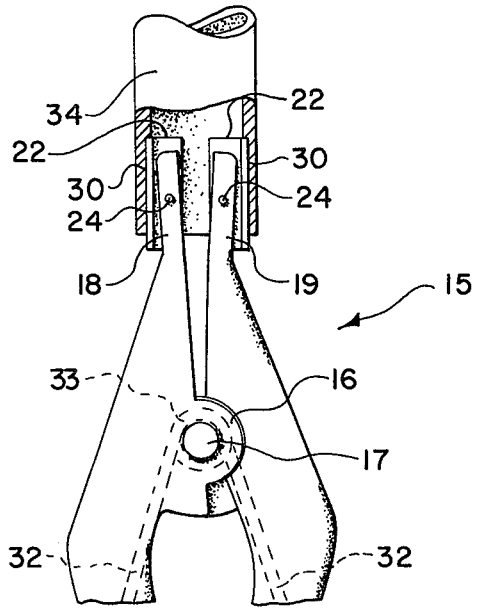
FIG. 2 is a fragmentary view of the tip of the reamer showing the same in operative position within a pipe.
Figure 4:
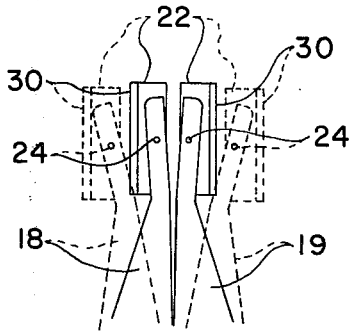
FIG. 4 is fragmentary plan view of the tip of the reamer showing the self-leveling characteristic thereof.

From the above, it can be seen that whenever handles 13 and 14 are squeezed toward each other, members 11 and 12 will pivot about pivot pin 17 thus moving blade support portions 18 and 19 away from each other. The sharp corner cutting edges 30 of blades 22 will longitudinally align themselves when disposed within the interior wall of a pipe, tube or coupling 34 by adjustably pivoting about pins 24 (see FIGS. 2 and 3). For larger and smaller interiors, the self-adjusting parallel cutting edge concept is further illustrated in FIG. 4 showing two of the infinite possible adjustments to fit two different interior diameters.

In addition to parallel cutting, the reamer of the present invention can, of course, be used to scrape the surface of conical shaped members with the blades 22 automatically adjusting to the tapered contour thereof.

In actual use of the device of the present invention, pressure on handles 13 and 14 is relaxed so that biasing spring 31 can move such handles to their farthest apart position as seen particularly clear in FIG. 1. The members 10 and 11 thus pivot about pivot pin 17 so that blade support portions 18 and 19 are juxtaposed to each other. The tool is thus in position for use.

Next the blade support portion 18 and 19 with their pivoted blade means 22 is inserted into the interior of the pipe, tube, coupling or joint to be reamed. Squeezing pressure is then applied between handles 13 and 14 causing blade support portions 18 and 19 to expand or move away from each other. When blades 22 come into contact with opposed wall portions of the interior 35 of the pipe or other member, such blades will pivot within slot 20 to give maximum surface contact between the four cutting edges 30 and said interior surface.

While maintaining the squeezing pressure between handles 13 and 14 of tool 10, the same is twisted relative to the member 34 being reamed whereby the four cutting edges 30 will scrape and thus remove undesirable surface coatings and burrs from surface 35. It has been found in actual use that only a couple of 180 degree twists are adequate to clean a copper pipe or coupling to receive solder.

Upon removal of squeezing pressure between handles 13 and 14, biasing spring 31 will move the handles apart thus moving blade support portions 18 and 19 together. The tool can then readily be longitudinally removed from the interior of the pipe or other member.

From the above, it can be seen that the present invention has the advantage of providing a simple to use, relatively inexpensive to produce tool for reamingly cleaning the interior surfaces of pipes, couplings and the like. The present invention also has the advantage of providing a long wearing reaming device which very seldom requires replacement of cutting edges. When replacement of the cutting means does become necessary, the simple removal of a single pivot pin per blade allows the change to be quickly and easily accomplished.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A tool for removing surface impurities from the interior of pipes, couplings and the like comprising: a pair of elongated members; one end of each of said members forming a handle portion and the other end thereof forming a scrapper support portion; means pivotably connecting said members intermediate their ends whereby when said handle ends are moved toward each other said support ends will move away from each other; and scrapper means in the form of an elongated, generally flat, T-shaped in cross section blade with the outer corners of the cross portion of the T acting as cutting edges with the intermediate area between such edges being adapted to accept scrape accumulations without interfering with the operation of the tool, and the shaft portion of each of said T-shaped scrapper means being pivotably inserted into a slot in each of said support ends whereby said scrappers can be inserted into the interior of a pipe or the like and expanded to come into firm self-leveling scrapping contact with the interior of such pipe by squeezing the handle portions toward each other and with a twisting motion said interior can be cleared of impurities.

2. The tool of claim 1 wherein a biasing spring is provided for tensioning said handles apart and thus said scrapper portions together.

3. The tool of claim 1 wherein said blade is held in operative position on said support by a pivot pin.

* * * * *